US009535358B2

(12) United States Patent
Fukuda et al.

(10) Patent No.: US 9,535,358 B2
(45) Date of Patent: Jan. 3, 2017

(54) CHARGING DEVICE

(71) Applicant: CANON KABUSHIKI KAISHA, Tokyo (JP)

(72) Inventors: Tadashi Fukuda, Tokyo (JP); Yoshiro Nishino, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/900,964

(22) PCT Filed: Jun. 23, 2014

(86) PCT No.: PCT/JP2014/066536
§ 371 (c)(1),
(2) Date: Dec. 22, 2015

(87) PCT Pub. No.: WO2014/208494
PCT Pub. Date: Dec. 31, 2014

(65) Prior Publication Data

US 2016/0139532 A1 May 19, 2016

(30) Foreign Application Priority Data

Jun. 28, 2013 (JP) ..... 2013-136147
Jun. 18, 2014 (JP) ..... 2014-125612

(51) Int. Cl.
*G03G 15/02* (2006.01)

(52) U.S. Cl.
CPC .... *G03G 15/0291* (2013.01); *G03G 2215/027* (2013.01)

(58) Field of Classification Search
USPC ..... 399/107, 110, 115, 130, 168, 170–173
See application file for complete search history.

(56) References Cited

U.S. PATENT DOCUMENTS 8,036,565 B2 * 10/2011 Nakajima ..... G03G 15/751 399/100
8,340,553 B2 * 12/2012 Kidaka ..... G03G 15/0258 399/115

(Continued)

FOREIGN PATENT DOCUMENTS

JP H04-93864 A 3/1992
JP 2010-113080 A 5/2010

(Continued)

*Primary Examiner* — Hoan Tran
(74) *Attorney, Agent, or Firm* — Canon U.S.A. Inc., IP Division

(57) ABSTRACT

In a corona charger including a housing that encloses a discharge electrode and has an open portion on a charging-object side and a shutter that opens and closes the open portion, if discharge products dropped from ends of the shutter adhere to a photosensitive member and absorbs moisture, an image defect called "image deletion" may occur. A charging device includes a corona charger including a discharge electrode and shields provided on two respective sides of the discharge electrode. The corona charger has an open portion on a charging-object side thereof. The open portion is opened and closed by a sheet-type shutter in a longitudinal direction of the charger. The sheet-type shutter is curled in a transverse direction such that a central portion bulges, with respect to two ends, in a thickness direction of the shutter from a front surface that is nearer to the discharge electrode toward a back surface.

21 Claims, 13 Drawing Sheets

(56) References Cited

U.S. PATENT DOCUMENTS

| | | | | |
|---|---|---|---|---|
| 8,532,518 | B2 * | 9/2013 | Torimaru | G03G 15/161 399/169 |
| 8,649,701 | B2 * | 2/2014 | Makino | G03G 15/0291 399/170 |

FOREIGN PATENT DOCUMENTS

| | | | |
|---|---|---|---|
| JP | 2010-145840 | A | 7/2010 |
| JP | 2010-145851 | A | 7/2010 |
| JP | 2011-186227 | A | 9/2011 |
| JP | 2012-128303 | A | 7/2012 |
| WO | 2011/111160 | A1 | 9/2011 |

* cited by examiner (a)

(b)

(a)

(b)

(a)

(b)

(a)

(b)

CHARGING DEVICE

TECHNICAL FIELD

The present invention relates to a charging device included in an image forming apparatus employing an electrophotographic process, such as a copier, a printer, a facsimile, or a multifunction machine having two or more of the foregoing functions.

BACKGROUND ART

Regarding electrophotographic image forming apparatuses, a charging method is known in which a photosensitive member as a charging object is charged by a corona charger as a charging device. In particular, a corona charger called scorotron is known. The scorotron includes a grid electrode for stabilizing the potential for charging the photosensitive member. In such a configuration, it is known that the grid electrode of the corona charger is provided in proximity to the photosensitive member so that uniform charging of the photosensitive member is performed efficiently.

Furthermore, in a typical internal configuration of the corona charger, a discharge electrode is enclosed by a housing that includes shields provided on two respective sides of the discharge electrode, and the housing has an open portion on a side thereof facing the photosensitive member as the charging object. It is known that a surface of the photosensitive member that faces a space between the shields of the corona charger is charged by corona discharge through the open portion of the housing.

On the other hand, it is known that discharge products such as ozone $O_3$ and nitrogen oxides $NO_x$ are generated when corona discharge occurs in the air. If any discharge products adhere to the photosensitive member and, moreover, absorb moisture, the surface resistance in such a portion having the discharge products is lowered. This may trigger an image defect so-called "image deletion" in which an electrostatic latent image that is faithful to image information is not formed.

Accordingly, a configuration is disclosed by PTL 1 in which a photosensitive member and an open portion that is provided on a photosensitive-member side of a housing of a corona charger are shielded from each other by a shutter provided between the two and being movable openably and closably in the longitudinal direction of the charger. Specifically, the leading end of a sheet-type shutter in a closing direction is supported by a carriage, and the carriage is moved in the longitudinal direction of the corona charger, whereby the open portion and the photosensitive member are shielded from each other when image formation is not performed. Thus, adhesion of discharge products to the photosensitive member is suppressed. Furthermore, according to PTL 1, the shape of the shutter is regulated in the circumferential direction of the photosensitive member such that a central portion bulges toward the housing with respect to two ends.

CITATION LIST

Patent Literature

PTL 1: Japanese Patent Laid-Open No. 2010-145840

SUMMARY OF INVENTION

Technical Problem

However, in the corona charger disclosed by PTL 1, even if the open portion and the photosensitive member are shielded from each other by the shutter, discharge products adhering to the shutter on a surface facing the housing and in a portion near each end in the circumferential direction of the photosensitive member may drop onto the photosensitive member because the shape of the shutter is regulated in the circumferential direction of the photosensitive member such that the central portion bulges toward the housing with respect to the two ends.

In such an event, the discharge products dropped from the end of the shutter may adhere to the photosensitive member and absorb moisture. Consequently, an image defect called "image deletion" may occur.

Solution to Problem

Hence, a charger according to a first aspect of the present invention is "a charging device that charges a photosensitive member. The charging device includes a corona charger including a discharge electrode that discharges electricity when a voltage is applied, shields that are provided on two respective sides of the discharge electrode, and an open portion that is provided nearer to the photosensitive member than the discharge electrode is; a sheet-type shutter movable for opening and closing the open portion; a fixed member fixed to a leading end of the shutter that is on a downstream side in a direction in which the shutter moves when the shutter is closed; and a moving mechanism that holds the fixed member and moves the shutter in a longitudinal direction of the corona charger. At least a portion of the shutter in the longitudinal direction excluding the leading end to which the fixed member is fixed is curled in a transverse direction of the shutter such that a central portion bulges, with respect to two ends, in a thickness direction of the shutter from a front surface that is nearer to the discharge electrode toward a back surface that is farther from the discharge electrode."

A charger according to a second aspect of the present invention is "a charging device that charges a photosensitive member. The charging device includes a corona charger including a discharge electrode that discharges electricity when a voltage is applied, a plurality of shields that are provided on two respective sides of the discharge electrode, and an open portion that is provided nearer to the photosensitive member than the discharge electrode is; a sheet-type shutter movable for opening and closing the open portion; and a moving mechanism that moves the shutter in a longitudinal direction of the corona charger. The corona charger further includes a regulating portion that regulates a shape of the shutter in the transverse direction of the shutter such that, in a state where the shutter is closed, a central portion bulges, with respect to two ends, in a thickness direction of the shutter from a front surface that is nearer to the discharge electrode toward a back surface that is farther from the discharge electrode."

Advantageous Effects of Invention

According to the present invention, the occurrence of image deletion can be suppressed by reducing the probability that discharge products at the ends of the shutter may drop onto the surface of the charging object.

DESCRIPTION OF EMBODIMENTS

Now, an outline configuration of an image forming apparatus will be described, and a charging device will then be described in detail with reference to the drawings. The dimensions, materials, shapes, relative positions, and other factors of individual elements do not limit the range of application of the present technical scope thereto, unless otherwise specified.

First Embodiment

First, an outline configuration of an image forming apparatus will be described briefly. Then, a charger (corona charger) according to the first embodiment will be described in detail.

§1. {Outline of Image Forming Apparatus}

A portion (an image forming unit) of a printer 100 that are involved in image formation will now be described briefly.

(Outline of Overall Configuration of Image Forming Apparatus)

Figure 1:
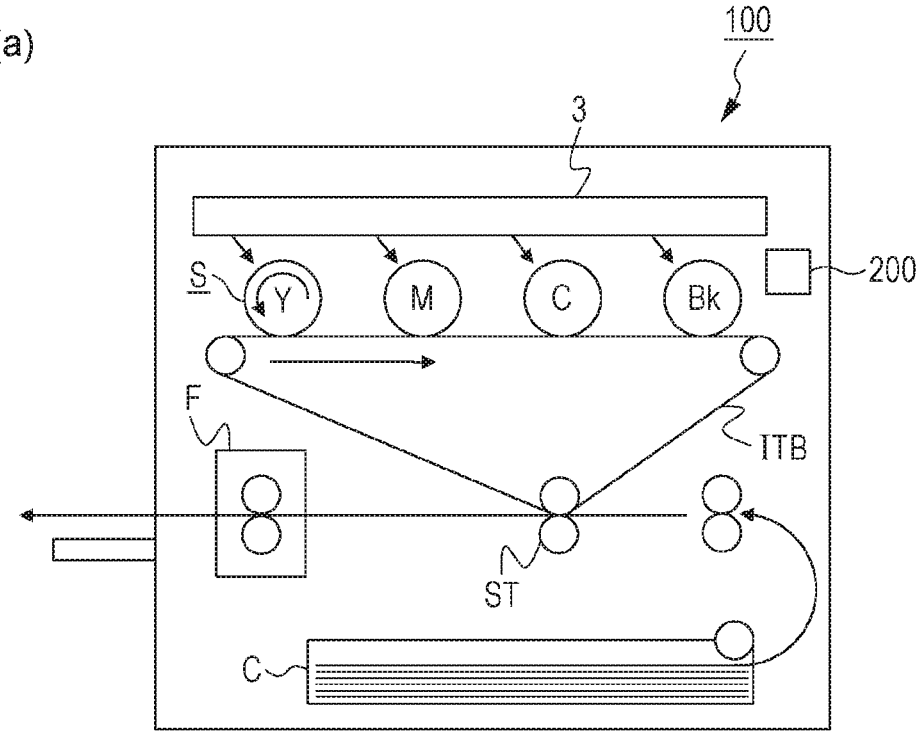
FIGS. 1 (1*a* and 1*b*) includes schematic sectional views of an image forming apparatus.
Figure 1:
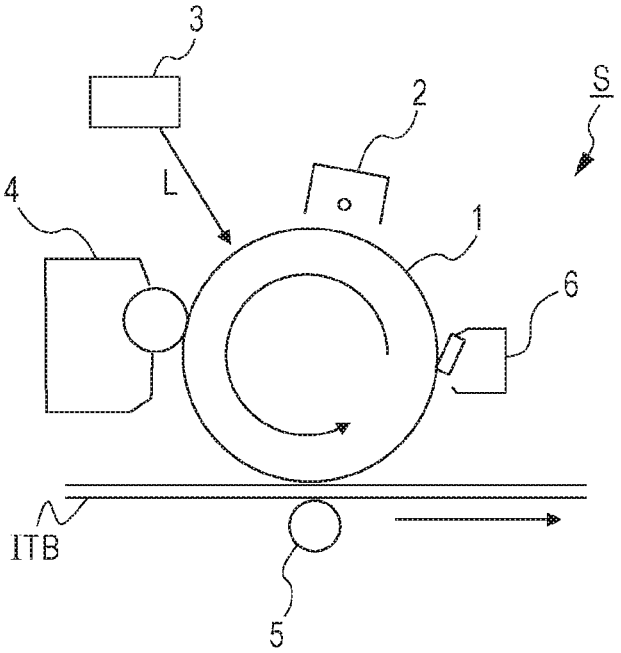

FIG. 1(*a*) is a diagram illustrating an outline configuration of the printer 100 as an image forming apparatus. The printer 100 as the image forming apparatus includes first to fourth stations S (Bk to Y) and forms images on respective photosensitive drums with different toners. FIG. 1(*b*) is a detailed enlargement of one of the stations as image forming units. The stations are all substantially the same, except the kinds (spectral characteristics) of the toners for developing electrostatic images formed on the photosensitive drums. Therefore, a first station (Y) will be described as a representative.

The station S(Y) as an image forming unit provided at the upstreammost position includes the photosensitive drum 1 (a photosensitive member) as a photosensitive member, which is a charging object, and a corona charger 2 as a charger that charges the photosensitive drum 1. After the photosensitive drum 1 is charged by the corona charger 2, exposure light L is emitted from a laser scanner 3 as an exposure unit, whereby an electrostatic image is formed on the photosensitive drum. The electrostatic image formed on the photosensitive drum 1 (on the photosensitive member) is developed with a yellow toner contained in a developing device 4 as a developing unit, whereby a toner image is formed. The toner image developed on the photosensitive drum 1 is transferred by a transfer roller 5 as a transfer unit to an intermediate transfer belt ITB as an intermediate transfer member, which is a transfer medium. Post-transfer toner particles staying on the photosensitive drum 1 instead of being transferred to the intermediate transfer belt are removed by a cleaning device 6 including a cleaning blade. A set of the corona charger, the exposure unit, and the developing unit that are involved in the formation of the toner image on the photosensitive drum 1 (on the photosensitive member) is referred to as image forming unit. The corona charger 2 (the charger) will be described in detail later.

Thus, toner images transferred in order of yellow (Y), magenta (M), cyan (C), and black (Bk) from the photosensitive drums 1 included in the respective stations are superposed one on top of another on the intermediate transfer belt. The toner images thus superposed are transferred to a recording material at a secondary transfer portion ST. The recording material is transported from a cassette C. Toner particles remaining on the intermediate transfer belt instead of being transferred to the recording material at the secondary transfer portion ST are removed by a belt cleaner, which is not illustrated.

The toner images transferred to the recording material are fixed to the recording material by a fixing device F that thermally fixes the toners by coming into contact with and thermally fusing the toners. The recording material having the fixed image is discharged to the outside of the apparatus. This is the outline of the overall configuration of the image forming apparatus.

§2. {Outline Configuration of Corona Charger}

An outline configuration of the corona charger will now be described. Then, an operation of opening and closing a shutter and an operation of cleaning the surface of a grid electrode by using a grid cleaning member will be described briefly.

(Outline Configuration of Corona Charger)

Figure 2:
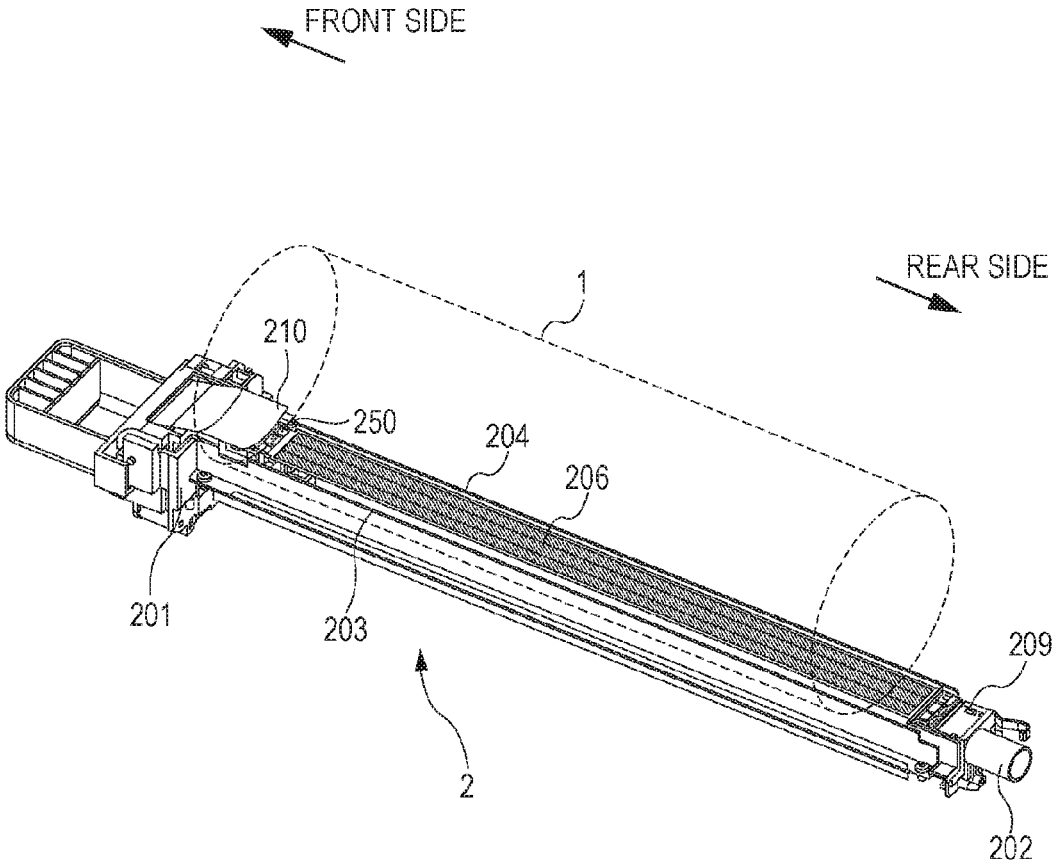
FIG. 2 is a perspective view of a corona charger according to an embodiment and illustrates an appearance thereof.
Figure 3:
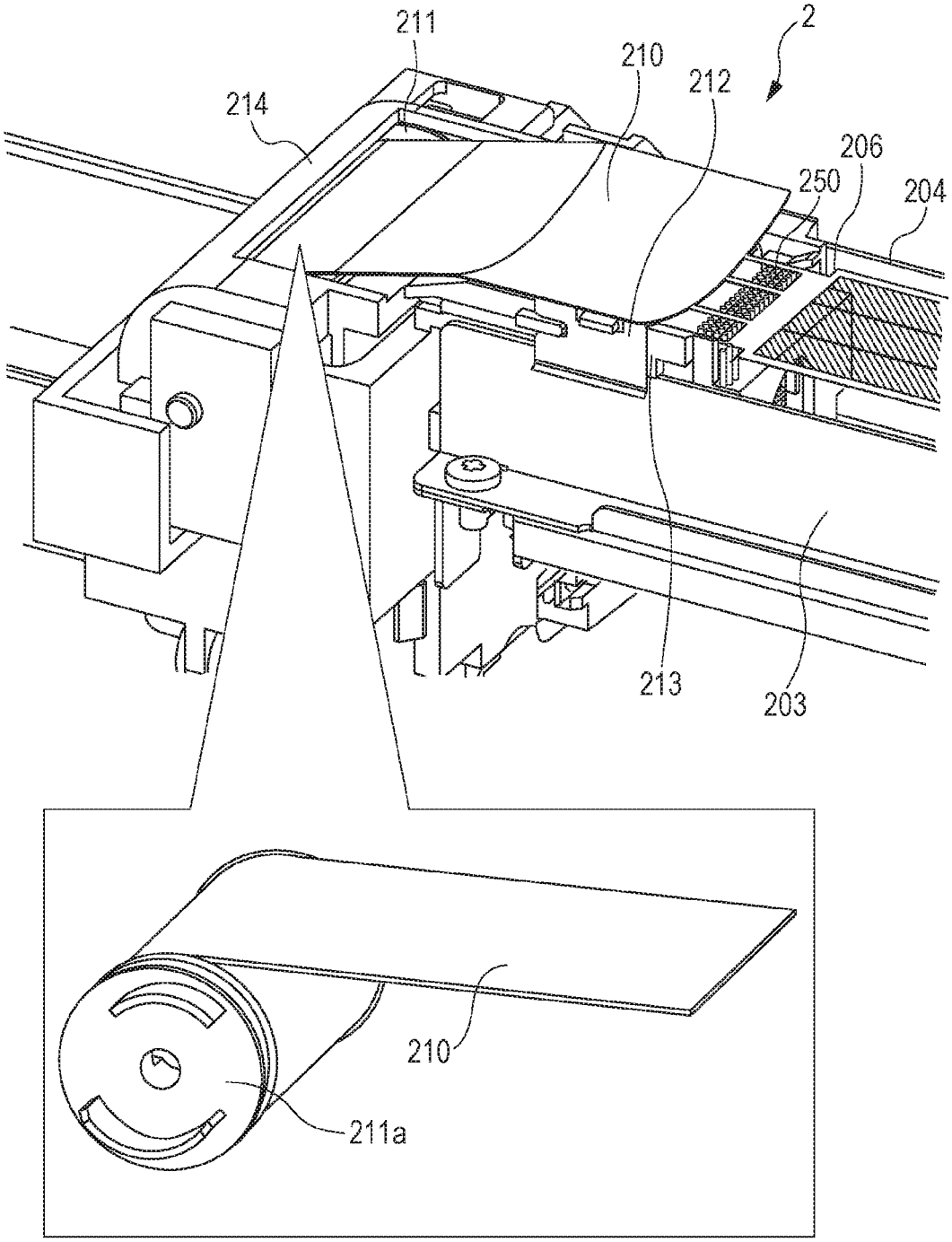
FIG. 3 is a first enlargement of a shutter storing portion and periphery thereof included in the corona charger according to the embodiment.

FIG. 2 is a schematic perspective view of the corona charger 2 as the charger forming the charging device that is seen from a photosensitive-drum side (a photosensitive-member side). FIG. 3 is an enlargement of a shutter storing portion, as sheet-type-shutter-winding means, and periphery thereof included in the corona charger according to the first embodiment. The corona charger 2 includes a grid electrode 206 and a grid cleaning brush 250 that cleans the grid electrode. The corona charger 2 further includes a sheet-type shutter 210 that is openably and closably movable in the longitudinal direction of the charger. The charger is provided on the photosensitive-drum side (a charging-object side) of a housing that encloses a discharge electrode of the corona charger. The shutter 210 is capable of covering an open portion while moving in such a manner as to be opened or closed.

The corona charger 2 includes the housing. The housing includes a front block 201, a rear block 202, and shields 203 and 204. Although not illustrated in FIG. 2 because being hidden behind the shields and the blocks, a discharge wire 205 as the discharge electrode to be described later referring to FIG. 4 extends between the front block 201 and the rear block 202. The discharge wire 205 in this state is enclosed by the housing. When a voltage (a charging bias) is applied to the discharge wire by a high-voltage power supply S, which is not illustrated in FIG. 2, the discharge wire discharges electricity and charges the surface of the photosensitive drum 1 (the photosensitive member) as the charging object. The discharge electrode extending on the inner side of the shields may have a round cross-sectional shape or a saw-toothed shape. The discharge electrode is not limited to a wire and may be a plate-type electrode.

The discharge electrode may be made of stainless steel, nickel, molybdenum, tungsten, or the like. In the first embodiment, the discharge wire 205 is made of tungsten, which exhibits very high stability among various metals. The diameter of the discharge wire is preferably 40 μm to 100 μm. If the diameter of the charging wire is too small, the charging wire may be broken by the collision of ions generated by the discharge. In contrast, if the diameter of the charging wire is too large, the voltage to be applied to the discharge wire 205 for producing stable corona discharge becomes high. If the voltage applied is high, ozone tends to be generated. Moreover, problems such as an increase in the cost of the power supply arise.

In the first embodiment, the discharge wire 205 as the discharge electrode is a tungsten wire having a diameter of 60 μm and is provided parallel to the axis of rotation of the photosensitive drum. Employing tungsten, which is less corrosive, as the material can reduce the probability that the wire itself may be decomposed by corrosion and generate dust or the wire surface may be roughened by corrosion and catch foreign substances.

Figure 4:
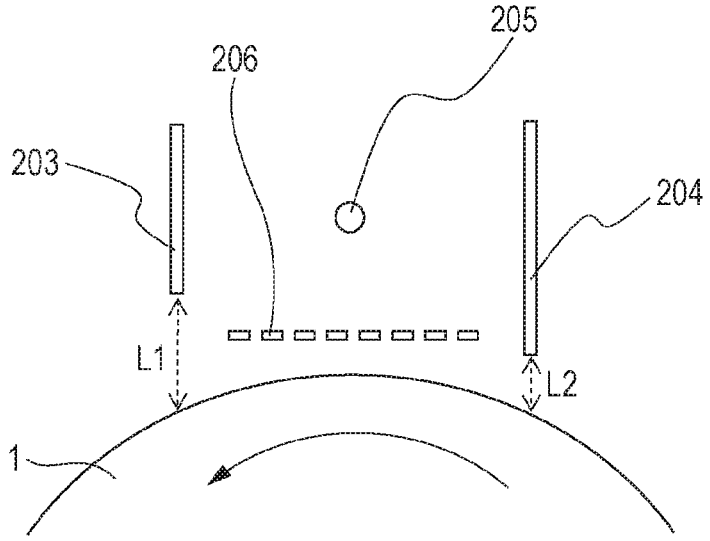
FIGS. 4 (4*a* and 4*b*) is a first diagram schematically illustrating a section of a corona charger according to the embodiment.
Figure 4:
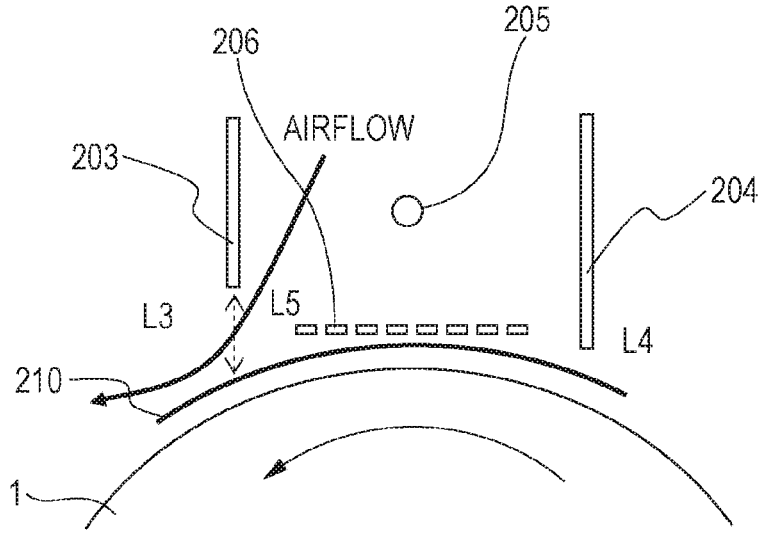

FIGS. 4(*a*) and (*b*) are exemplary sectional views of a charger according to a comparative embodiment that are taken in the transverse direction. FIG. 4(*a*) illustrates a state where a sheet-type shutter 210, to be described later, is opened. FIG. 4(*b*) illustrates a state where the sheet-type shutter 210 is closed. Referring to FIG. 4(*a*), a sectional configuration of the charger will be described. In the cross section of the corona charger 2 that is taken in the transverse direction, the shield 203 as a first shield portion and the shield 204 as a second shield portion are provided on two respective sides of the discharge wire 205 in such a manner as to face each other. The shields were made of stainless steel. The shields may be affected by discharge products generated from the discharge wire 205 and are therefore desirably made of a less corrosive material.

The shield 203 as the first shield portion is positioned on the downstream side with respect to the shield 204 as the second shield portion in the direction of rotation of the photosensitive member at the time of image formation. In the first embodiment, the shield 203 has a length of 18 mm in a section orthogonal to the longitudinal direction of the charger. A distance L1 between the shield 203 and the photosensitive drum 1 is 9.0 mm. The shield 204 has a length of 24 mm in a section parallel to the transverse direction of the charger. A distance L2 between the shield 204 and the photosensitive member 1 is 4.0 mm. The distance between the shield 203 and the shield 204, i.e., the length of the open portion of the housing in the transverse direction, is 34.0 mm. The grid electrode 206 is positioned at 1.5 mm from the photosensitive drum 1. The sheet-type shutter 210 to be described later runs between the grid electrode 206 and the photosensitive drum 1. The sheet-type shutter 210 covers substantially the entirety, in the transverse direction and in the longitudinal direction, of the open portion of the charger. The open portion is defined by the housing formed of the front and rear blocks 201 and 202 and the shields 202 and 203. Detailed description of a section illustrated in FIG. 4(*b*) including the shields 203 and 204, the grid electrode 206, the photosensitive drum 1, and the sheet-type shutter 210 will be given later.

(Grid Electrode)

The corona charger 2 includes the grid electrode 206 having a flat plate-like shape and provided in the open portion defined by the housing including the shields 203 and 204. The grid electrode 206 is provided nearer to the photosensitive drum than the discharge wire is. The grid electrode 206 is positioned between the discharge wire 205 and the photosensitive drum 1 and controls the amount of current that flows toward the photosensitive member with the application of the charging bias.

In the first embodiment, a so-called etching grid obtained by etching a thin, metal, flat plate (a thin plate) is used as the grid electrode. As illustrated in FIG. 3, the etching grid includes beam portions at two respective ends in the longitudinal direction of the grid electrode, with through holes (net holes) arranged obliquely between the beam portions.

The base member of the flat plate-like grid electrode 206 that was etched was a thin metal plate made of an austenitic stainless steel (SUS304) and having a thickness of about 0.03 mm. The thin metal plate was etched such that a mesh portion (net portion) having many through holes (mesh holes) were formed. Furthermore, a surface layer made of tetrahedral amorphous carbon (hereinafter abbreviated to ta-C), which has a chemically high inactivity with respect to discharge products generated by corona discharge, was formed on the SUS base member. Hereinafter, the surface layer made of ta-C is referred to as ta-C layer. The ta-C layer formed on the surface of the base member of the grid electrode is provided not only over the front and back major surfaces of the mesh portion but also over the edges of the through holes provided in the mesh portion.

Providing the ta-C layer over the surfaces of the grid electrode not only makes the grid electrode resistant to corrosion but also gives the grid electrode high releasability, so that foreign substances are less likely to adhere to the surfaces of the grid electrode. Particularly, it is beneficial in that foreign substances are less likely to adhere not only to the major surface facing the discharge wire but also to the edges of the through holes provided in the mesh portion.

The base member according to the first embodiment is not limited to the above base member and may be a base member that is made of another austenitic stainless steel, a martensitic stainless steel, a ferritic stainless steel, or the like. In the first embodiment, ta-C used for forming the surface layer is, in general, a kind of DLC (diamond like carbon). Typically, DLC has an amorphous structure containing a little amount of hydrogen and in which diamond bonds (sp3 bonds) and graphite bonds (sp2 bonds) coexist. In the first embodiment, the surface layer is made of ta-C. Alternatively, the surface layer may be made of any DLC other than ta-C. Moreover, the surface layer is not limited to be made of ta-C or DLC and may be formed by plating.

Figure 5:
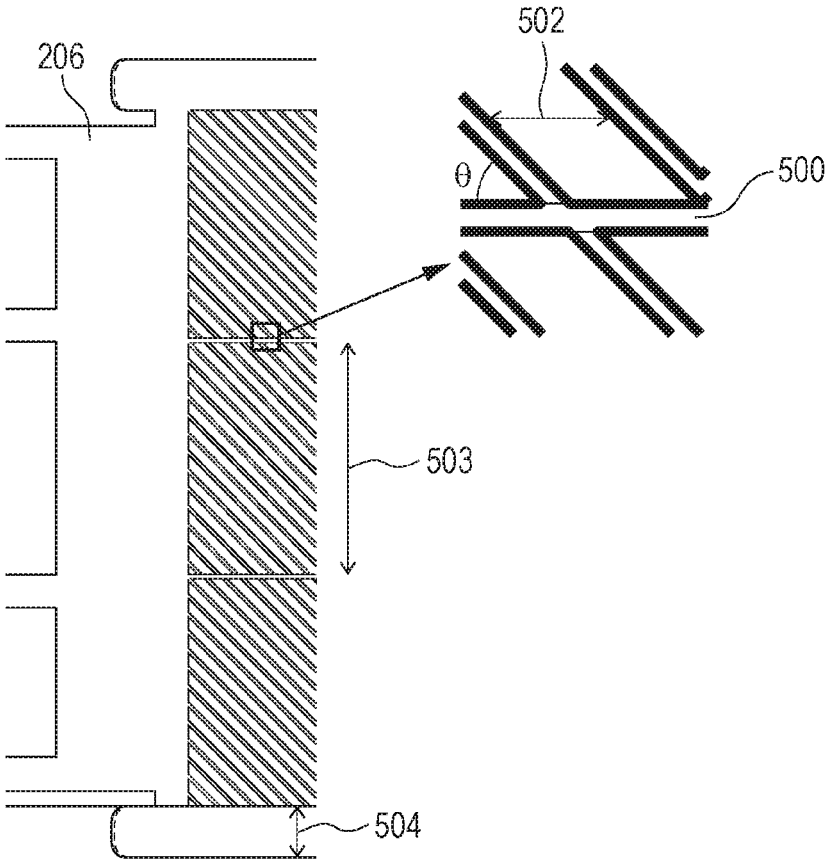
FIG. 5 is a diagram illustrating the shape of an etching grid according to the embodiment.
Figure 11:
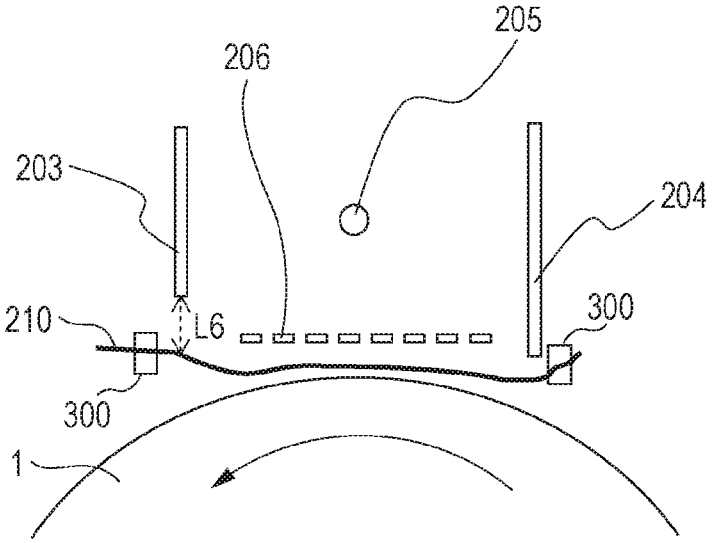
FIG. 11 is a fourth diagram schematically illustrating a section of the corona charger according to the embodiment.

FIG. 5 is an enlargement of an etching pattern of the mesh portion, having a plurality of through holes, of the grid electrode according to the first embodiment that is seen from the photosensitive-drum side. Referring to FIG. 11, the etching pattern is formed of base wires 500 each extending substantially parallel to the axis of rotation of the photosensitive drum and to the discharge wire, and oblique portions 501 each being at an angle θ with respect to the base wires. The etching pattern is sectioned into three portions by the base wires 500. The three portions each extend substantially parallel to the discharge wire. Each of the three portions sectioned by the base wires has a pattern having fine through holes that are defined by the oblique wires 501. As the area ratio of the through holes with respect to the mesh portion becomes larger, the charging potential can be evened out more easily. Considering this fact, the area ratio of the through holes with respect to the mesh portion can be determined.

The flat plate-like grid electrode 206 is held by holding portions 207 and 209 provided on the front block 201 and the rear block 202, respectively. The grid electrode 206 is released by operating a knob 208 included in the holding portion 207 provided on the front block 201, thereby being easily removable (see FIG. 6). Furthermore, a portion of the flat grid electrode 206 that is near the holding portion 209 is bent, whereby the grid electrode 206 is slightly stretchable. Therefore, when an external force is applied to the grid electrode that is held on the corona charger, the grid electrode is movable to some extent.

(Cleaning Member)

Figure 6:
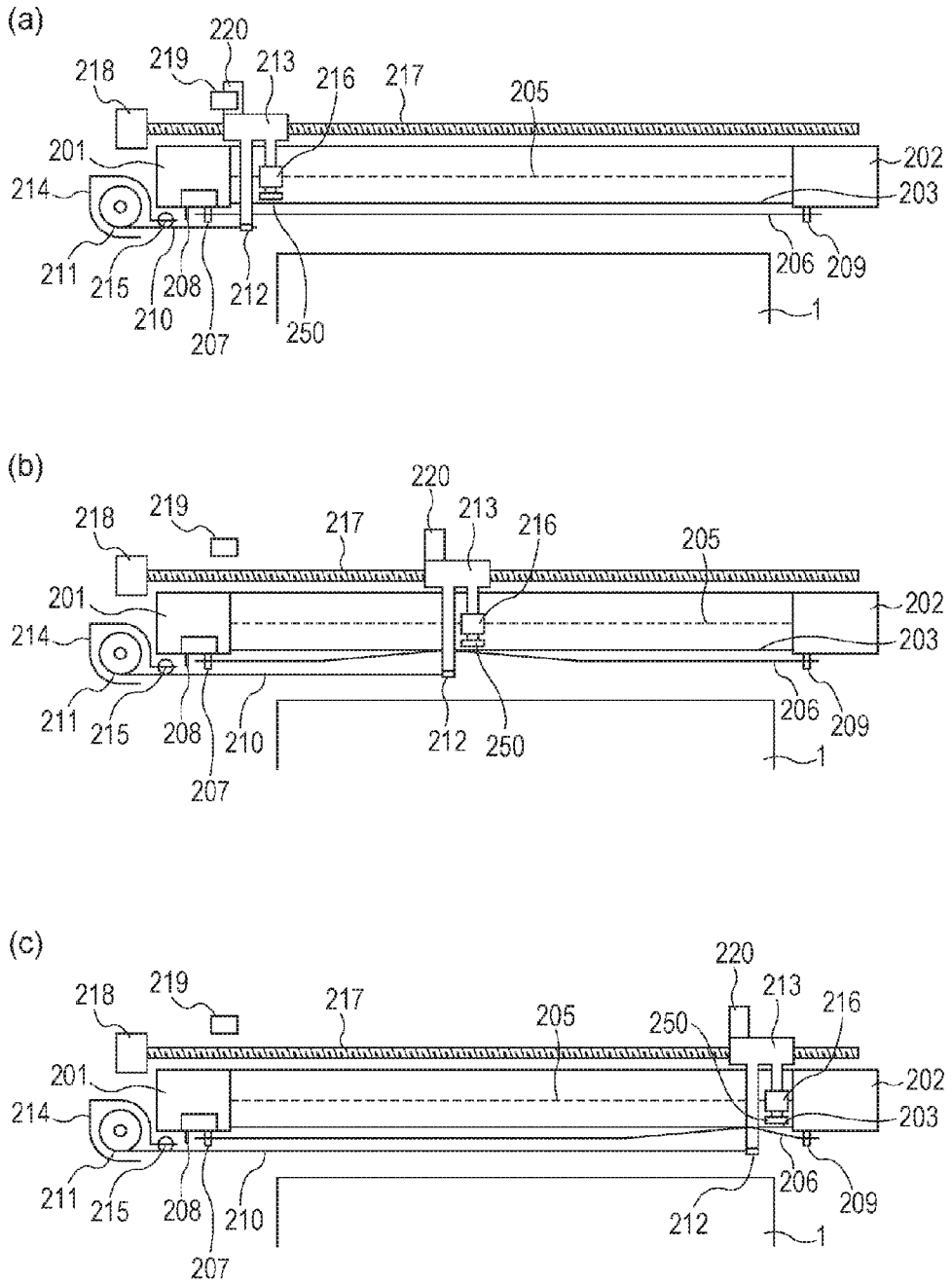
FIGS. 6 (6*a*, 6*b* and 6*c*) includes side views of the corona charger according to the embodiment and illustrate how a shutter is opened or closed.

FIGS. 6(*a*) to (*c*) illustrate a sectional configuration of the charger according to the first embodiment. Referring to FIG. 6, a cleaning pad 216 that cleans the discharge wire 205 is provided. Furthermore, the cleaning brush 250 as a cleaning member that cleans the grid electrode 206 is provided.

As illustrated in FIG. 6, the cleaning pad 216 and the cleaning brush 250 are moved in the longitudinal direction of the corona charger by a driving screw 217 that rotates by receiving a driving force from a driving motor 218. While moving, the cleaning brush 14 that cleans the grid electrode 206 is in contact with the surface of the grid electrode 206 that faces the discharge wire and thus cleans the grid electrode.

In the first embodiment, a set of sponges made of flame-retardant CR rubber and having a hardness of 30±5° is employed as the cleaning pad 216 as a discharge-electrode-cleaning member. The sponges are provided in such a manner as to hold the discharge wire 205 from two respective sides. A cleaning-brush holder 213 that holds the cleaning brush is made of ABS resin or, alternatively, any other resin such as PC. The cleaning brush as the grid cleaning member 250 includes an acrylic brush subjected to flame-retardant treatment, and the brush is woven in a piece of base fabric. Specifically, the cleaning brush 250 includes acrylic pile threads each having a thickness of 9 decitexes and woven at a density of 70000 pile threads per inch. The length of the cleaning brush 250 is set such that the cleaning brush 250 bites into the plate-like grid electrode by 0.7 to 1.0 mm at the time of the cleaning of the grid electrode.

With the above biting amount and the above pile shape and with the pattern size of the etching grid illustrated in FIG. 5, the tips or other parts of some of the plurality of cleaning-brush pile threads are taken into the fine through holes defined by the base wires and the oblique wires. As the plurality of cleaning-brush pile threads successively come into contact with foreign substances adhered to the grid, a high ability of removing foreign substances on the grid is provided. Moreover, since the pile threads are partially taken into the through holes, not only the ability of removing foreign substances adhered to the major surface of the grid electrode that faces the discharge wire but also the ability of removing foreign substances adhered to the edges of the through holes is improved.

However, depending on the shape of the through holes and the biting amount of the brush, no parts of the pile threads are taken into the through holes of the grid electrode. In such a case, the pile threads only rub the major surface of the grid, and the high cleaning ability is not expected. Hence, if the cleaning member is a brush, the biting amount of the cleaning brush is preferably set such that the cleaning brush is taken into the through holes of the grid. The biting amount needs to be at least larger than zero.

The cleaning pad is not limited to a set of sponges and may be a sheet having a contact surface to which abrasive particles of alumina or the like are applied. The cleaning brush may be made of nylon, PVC (polyvinyl chloride), PPS (polyphenylene sulfide), or the like. Moreover, not only a member having bristles but also a pad (an elastic member), such as a felt or sponge member, or a sheet to which an abrasive such as alumina or silicon carbide is applied may be used.

(Sectional Configuration Around Shutter)

Referring now to FIG. 4(*b*), a sectional configuration around the shutter will be described.

The corona charger 2 includes the sheet-type shutter 210 that covers the entirety of the open portion (having a longitudinal length of about 370 mm and a transverse length of 34 mm) of the housing, the open portion facing the photosensitive drum. The sheet-type shutter 210 moves in the space between the grid electrode 206 and the photosensitive drum 1 and in the longitudinal direction of the charger, thereby opening and closing the open portion.

FIG. 4(*b*) is a transverse sectional view of the charger, with the sheet-type shutter 210 closed. Referring to FIG. 4(*b*), the section taken in the transverse direction and including the sheet-type shutter 210 will now be described. The sheet-type shutter 210 is positioned between the grid electrode 206 and the photosensitive drum 1. As described above with reference to FIG. 4(*a*), the distances L1 and L2 between the photosensitive drum 1 and the shields 203 and 204 are different. The gap distance L1 between the shield 203 and the photosensitive drum 1 is larger than the gap distance L2 between the shield 204 and the photosensitive drum 1. The reason for this is to remove discharge products and scattered toner particles from the inside of the charger by causing air to circulate along a path illustrated by an arrow in FIG. 4(*b*). In this air circulation called airflow, air is taken in from the outside by a fan 200 illustrated in FIG. 1, and the air circulates in such a manner as to be distributed among the stations provided in the image forming apparatus. The housing of the corona charger 2 has an opening for taking in the airflow on a side thereof that is opposite the photosensitive member. The airflow taken into each of the stations flows into the charger from the opening and flows out of the charger from the gap between the shield 203 and the photosensitive member. The airflow thus discharged from the charger is taken into a duct provided at a position of the photosensitive member that is on the downstream side in the direction of rotation of the photosensitive member with respect to the position to which the exposure light from the laser scanner is applied and on an upstream side with respect to the position at which development is performed. The duct extends in the axial direction of the photosensitive member. Then, the airflow flows through a filter that removes toner particles and discharge products, and is exhausted to the outside of the image forming apparatus.

Figure 7:
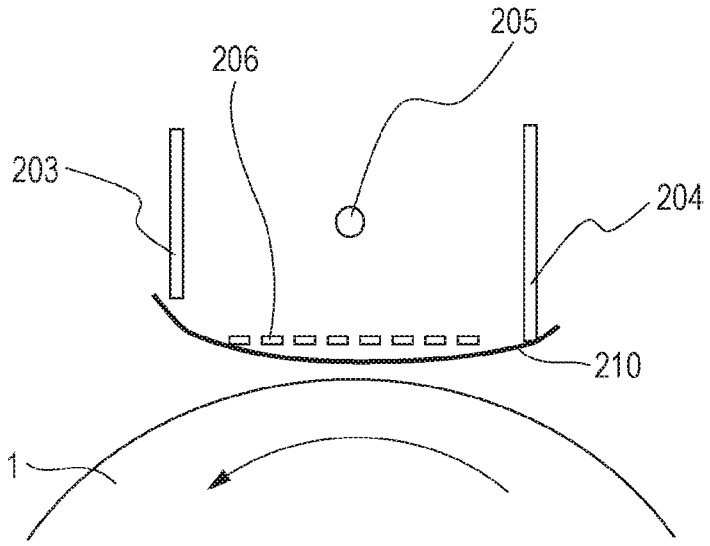
FIG. 7 is a second diagram schematically illustrating a section of the corona charger according to the embodiment.

If the shutter is shaped as illustrated in FIG. 4(*b*), discharge products on the surface of the shutter that faces the housing and near two ends of that surface in the circumferential direction of the photosensitive member may drop onto the photosensitive member. Hence, as illustrated in FIG. 7, the sheet-type shutter is curled in the traverse direction such that the two ends are positioned nearer to the charger than a central portion is. In other words, the shutter is curled in the transverse direction such that the central portion bulges, with respect to the two ends, in the thickness direction of the shutter from the front surface that is nearer to the discharge electrode toward the back surface that is farther from the discharge electrode. Since the sheet-type shutter is curled in the transverse direction such that the two ends are positioned nearer to the housing than the central portion is, the probability that discharge products may drop onto the photosensitive member from the ends of the sheet-type shutter can be reduced. Furthermore, since the gap distance L1 between the shield 203 and the photosensitive drum 1 is larger than the gap distance L2 between the shield 204 and the photosensitive drum 1, the length of the sheet-type shutter in the transverse direction from a point directly below the discharge electrode to an end that is nearer to the shield 203 is longer than the length of the sheet-type shutter from the point directly below the discharge electrode to the other end that is nearer to the shield 204. Furthermore, the sheet-type shutter is curled in such a manner as to cover the open portion. Consequently, the amount of discharge products that may adhere to the surface of the photosensitive drum can be further reduced, and the occurrence of image deletion can be suppressed.

In the first embodiment, for example, the curled sheet-type shutter is used. To curl the sheet-type shutter itself, a thermal processing method may be employed, for example. First, a flat sheet-type shutter 210 that is yet to undergo thermal processing is closely brought into contact with a hollow metal roller and is fixed thereto. Then, the metal roller to which the sheet-type shutter is fixed is heated in such a manner as to be kept at a predetermined temperature (in the first embodiment, 150° C.) by a heat source provided thereinside, and is left in that state for about ten minutes. Thus, the sheet-type shutter is shaped such that, in the transverse direction, the two ends are curled up with respect to the central portion.

To shape the sheet-type shutter such that the two ends in the transverse direction are positioned nearer to the housing than the central portion is, another processing method may be employed, instead of the above thermal processing method.

Since the sheet-type shutter is curled in the transverse direction such that the two ends are positioned nearer to the housing than the central portion is, the probability that a portion of the sheet-type shutter that is near the center in the transverse direction may interfere with the photosensitive drum 1 may increase. Hence, to prevent the photosensitive drum from being damaged even if the sheet-type shutter interferes with the photosensitive drum, the sheet-type shutter 210 may be a piece of soft, flexible, sheet-type nonwoven fabric having a thickness of 0.15 mm and including rayon fibers. In that case, there is no problem even if the sheet-type shutter 210 interferes with the photosensitive drum 1. The bending stiffness of the sheet used for the sheet-type shutter 210 according to the first embodiment was 15 to 25 kg/f. The bending stiffness was measured by using a gurley-type bending stiffness tester GAS-10 manufactured by Daiei Kagaku Seiki. If the bending stiffness is 80 kg/f or lower, no problem occurs at the interference with the photosensitive drum 1.

(Shutter and Shutter Storing Portion)

Referring now to FIG. 3, the sheet-type shutter and a configuration that winds up and stores the sheet-type shutter will be described.

In the image forming apparatus according to the first embodiment, the shortest distance between the grid electrode 206 and the photosensitive drum 1 in the state where the sheet-type shutter is open is as narrow as about 1.5 mm. Therefore, as described above, a piece of soft, flexible nonwoven fabric was used as the sheet-type shutter 210 so that the photosensitive drum was not damaged even if the photosensitive drum 1 and the sheet-type shutter interfered with each other.

The sheet-type shutter 210 is wound into a roll by a winding mechanism 211 and is thus stored in the winding mechanism 211, which is winding means that winds up the sheet-type shutter, at an end of the corona charger 2 in the longitudinal direction. The winding mechanism 211 includes a roller 211*a* as a winding shaft to which an end of the sheet-type shutter is fixed, and a torsion coil spring that urges the roller 211*a* but is not illustrated. The sheet-type shutter 210 is urged by the coil spring in a direction in which the shutter is wound (a direction for opening the open portion). Therefore, a central portion of the sheet-type shutter in the longitudinal direction is less likely to sag down. The winding mechanism 211 and a holding case 214 that holds the winding mechanism 211 are both held by the front block 201. The holding case 214 is provided, near a position from which the shutter is drawn out, with a guide roller 215 that guides the sheet-type shutter 210 such that the sheet-type shutter 210 does not interfere with the edges of the grid electrode 206, the holding portion 207 and the knob 208 thereof, and other associated elements. The sheet-type shutter is wound up by the winding means such that the surface thereof on the charger side faces inward. By winding up the sheet-type shutter such that the surface thereof on the housing side faces inward, the sheet-type shutter that has been curled can be made less likely to be decurled.

The other end of the sheet-type shutter 210 in the longitudinal direction (the leading end on the downstream side in the direction in which the shutter moves when closed) is fixed to a leaf spring 212, which is a fixed member. The leaf spring 212 holds the sheet-type shutter and pulls the sheet-type shutter in the closing direction. Meanwhile, the leaf spring 212 is regulated to be in an arch shape in the transverse direction such that the central portion bulges, with respect to the two ends, in the thickness direction of the shutter from the front surface that is nearer to the discharge electrode toward the back surface that is farther from the discharge electrode. Therefore, the leaf spring, which is harder than the sheet-type shutter, is prevented from interfering with the photosensitive drum and damaging the photosensitive drum 1, and the sagging of the sheet-type shutter is suppressed. In this case, the leading end of the sheet-type shutter that is on the downstream side in the closing direction is shaped like an arch in the transverse direction by the leaf spring 212 such that the central portion bulges toward the housing with respect to the two ends, whereas the sheet-type shutter itself is curled in the transverse direction such that the two ends are positioned nearer to the housing than the central portion is. Therefore, a portion of the sheet-type shutter excluding a portion near the leading end on the downstream side in the closing direction, i.e., excluding the portion where the leaf spring is attached, is shaped such that the two ends in the transverse direction are positioned nearer to the housing than the central portion is. Accordingly, the probability that discharge products may drop from the ends of the shutter onto the surface of the charging object can be reduced.

Furthermore, the leaf spring 212 as a pulling member/fixed member that holds the portion near the leading end of the sheet-type shutter 210 is connected to the carriage 213 as a movable member included in a moving mechanism. In the first embodiment, the sheet-type shutter 210 has a thickness of 0.15 mm, and the leaf spring 212 is made of a metal material having a thickness of 0.10 mm.

When the carriage 213 receives a driving force from the screw 217, which is included in the moving mechanism provided on a side of the corona charger that is opposite the photosensitive-drum side, and moves in the direction for closing the open portion, the sheet-type shutter 210 is drawn out of the winding mechanism 211. In contrast, when the carriage 213 moves in the direction for opening the open portion, the sheet-type shutter 210 is wound up by the winding mechanism 211 and is stored in the holding case 214. In this process, the wire cleaning pad 216 and the grid cleaning member 250 that are connected to the carriage 213 also move. In the first embodiment, since the sheet-type shutter 210 and the grid cleaning member 250 are driven by a single screw 217, the sheet-type shutter 210 and the grid cleaning member 250 operate together. If a plurality of drive sources are provided, the two can be driven independently of each other. However, employing the together-operating configuration as in the first embodiment can reduce the number of drive sources.

As a method of curling the sheet-type shutter, curling may be performed on the sheet-type shutter when the sheet-type shutter is wound up.

Figure 8:
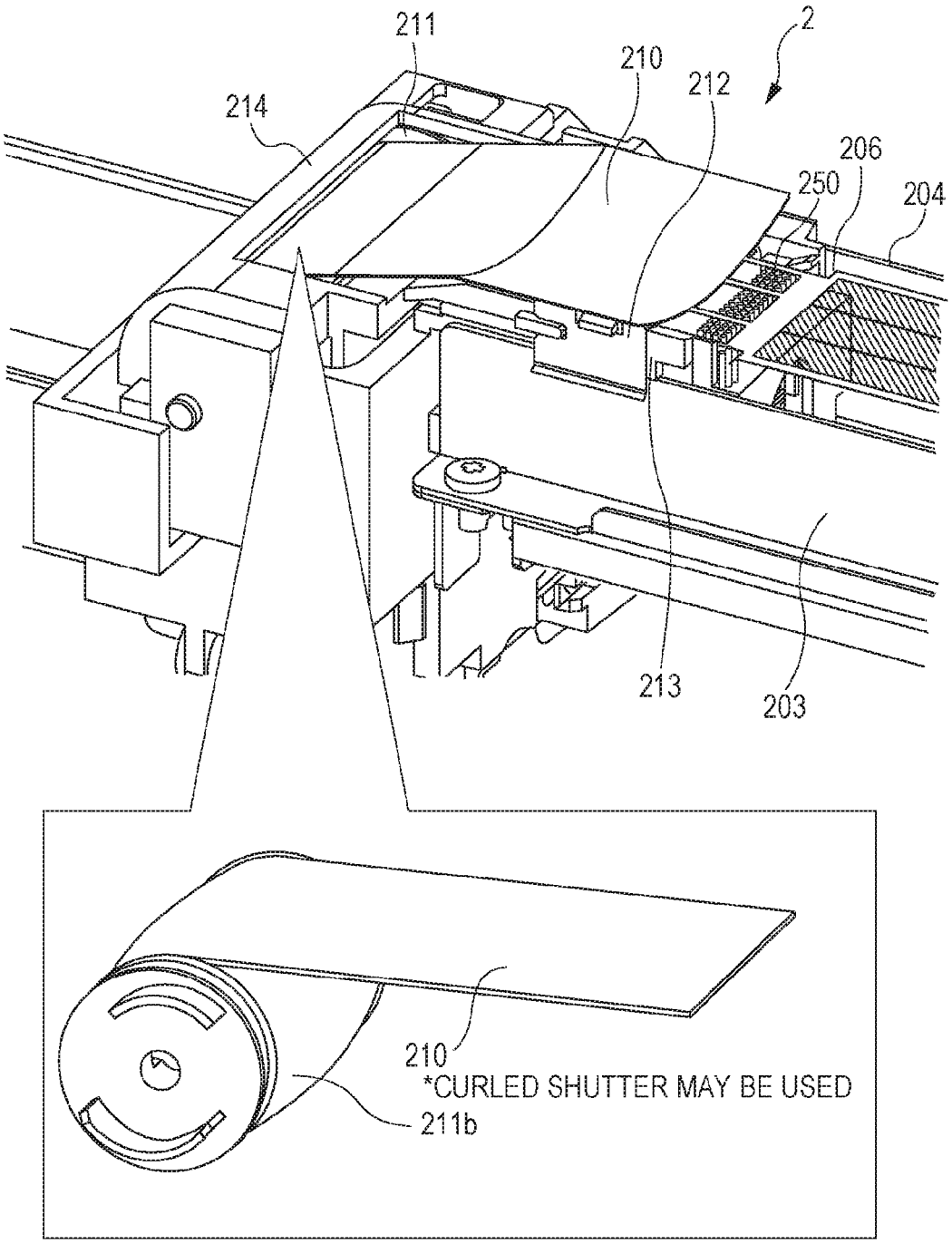
FIG. 8 is a second enlargement of the shutter storing portion and periphery thereof included in the corona charger according to the embodiment.

FIG. 8 illustrates a winding mechanism as winding means that winds up the sheet-type shutter in a case where curling is performed on the sheet-type shutter when the sheet-type shutter is wound up in the longitudinal direction. FIG. 8 also illustrates a roller 211*b* as a winding shaft included in the winding mechanism and onto which the shutter is wound. Referring to FIG. 8, the outer peripheral surface, which is a winding portion, of the roller 211*b* is not flat, unlike that of the roller 211*a*. The outside diameter of the portion onto which the shutter is wound is smaller at each of two ends in the rotation-axis direction than in a central part. That is, the roller has a bulging central part. Furthermore, as in the case illustrated in FIG. 3, the sheet-type shutter is wound up such that the surface thereof on the housing side faces inward. By employing the roller 211*b* having the above shape for winding, the sheet-type shutter 210 can be curled into a shape conforming to the shape of the roller 211*b*, and the sheet-type shutter 210 can be drawn out while that shape is maintained. Moreover, both the advance curling of the sheet-type shutter and the above roller shape may be employed. In that case, the curled shape can be maintained over a long time.

(Controlling Opening/Closing of Sheet-Type Shutter)

Figure 9:
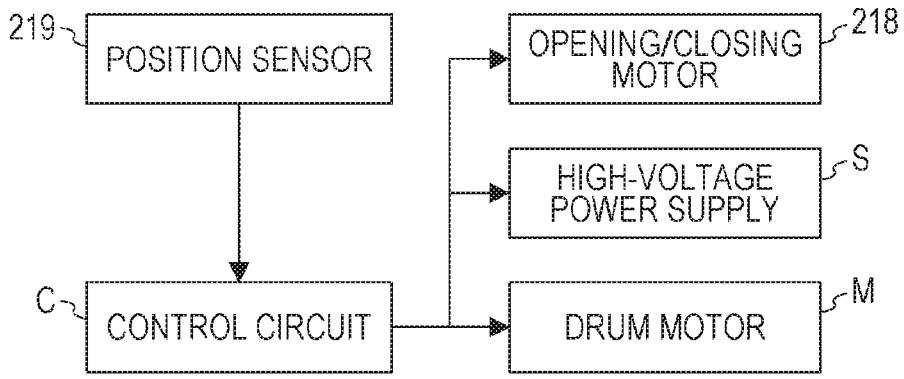
FIGS. 9 (9*a* and 9*b*) includes diagrams illustrating an operation of controlling the opening and closing of the shutter included in the corona charger according to the embodiment.
Figure 9:
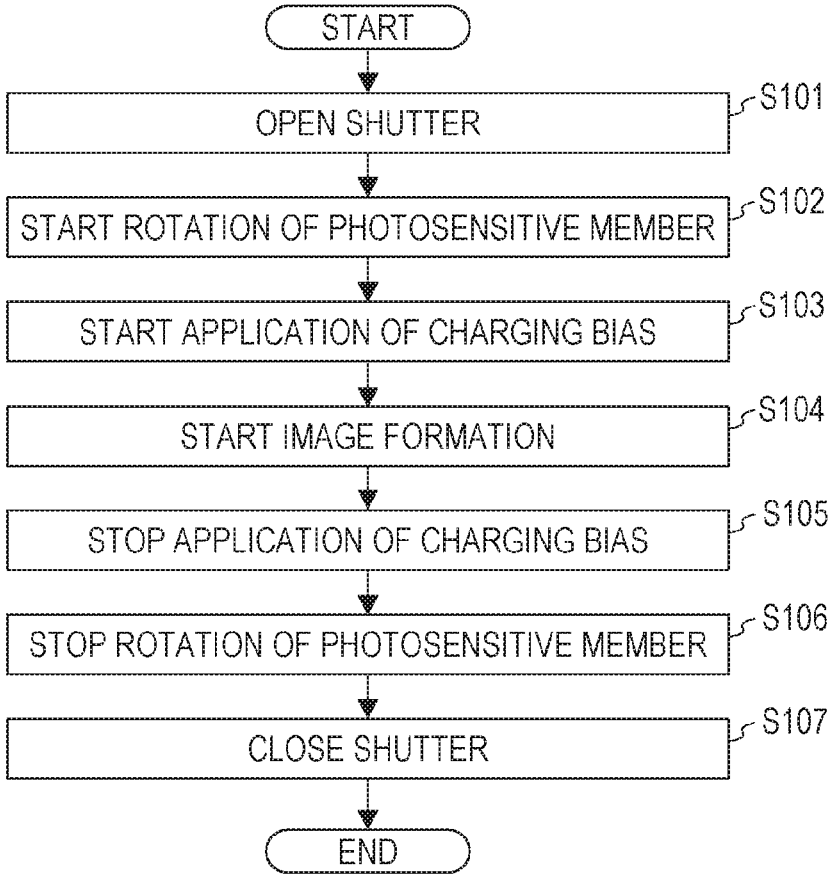

Now, an operation of controlling the opening and closing of the sheet-type shutter included in the corona charger 2 will be described briefly. FIG. 9(*a*) is a schematic block diagram of a control circuit. FIG. 9(*b*) is a flowchart illustrating details of the control operation.

As illustrated in FIG. 9(*a*), a control circuit (controller) C as controlling means controls an opening/closing motor, the high-voltage power supply, and a drum motor, which are drive sources, in accordance with programs stored therein. A position sensor notifies the control circuit of the presence/absence of a flag.

An operation of the corona charger during the image forming operation will now be described with reference to the flowchart.

With the supply of an image forming signal, if the sheet-type shutter is in the closed state, the control circuit C activates the opening/closing motor and thus moves the sheet-type shutter so as to open the open portion on the basis of the output from the position sensor 219. Furthermore, the control circuit C checks if the sheet-type shutter has been opened on the basis of the position sensor (S101). Subsequently, with the sheet-type shutter retracted (with the open portion being open), the control circuit C activates the drum motor M, whereby the photosensitive drum 1 is rotated (S102).

Furthermore, to charge the photosensitive drum, the control circuit C controls the high-voltage power supply S to apply a charging bias to the discharge electrode and the grid (S103).

Other image forming units are made to act on the photosensitive drum 1 that has been charged by the corona charger 2, whereby an image is formed on a sheet (S104). After the completion of image formation, the control circuit C stops the application of the charging bias to the corona charger (S105) and then stops the rotation of the photosensitive drum (S106).

After stopping the rotation of the photosensitive drum, the control circuit C causes the opening/closing motor 218 to rotate reversely and executes the operation of closing the open portion with the sheet-type shutter (S107). The sheet-type shutter 210 may be closed either immediately after image formation or at the elapse of a predetermined period of time after the completion of image formation.

§3. {Operation of Sheet-Type Shutter}

Referring now to FIG. 6, the position of the grid electrode in a grid cleaning operation and in the opening/closing of the sheet-type shutter will be described briefly. Then, a retracting mechanism that retracts the grid electrode toward the discharge wire and the grid cleaning operation will be described in detail.

(Opening/Closing of Sheet-Type Shutter and Position of Grid)

The carriage 213 as the movable member included in the moving mechanism moves in the longitudinal direction of the corona charger by being moved by the screw 217 and the opening/closing motor 218 that are included in the moving mechanism. The carriage 213 is provided with the grid cleaning member 250 and holds the cleaning pad 216 that cleans the discharge wire 205 as the discharge electrode. Thus, the discharge wire 205 and the grid electrode 206 are cleaned by the wire cleaning pad 216 and the grid cleaning brush 250, respectively, along with the opening or closing of the sheet-type shutter 210.

The corona charger 2 includes the position sensor 219, and a detection flag 220 that shields a detecting portion of the position sensor 219 when the shutter is at the open position. The position sensor 219 determines that the sheet-type shutter 210 is at the open position (a home position) if the detecting portion is shielded by the detection flag 220.

FIG. 6(*a*) is a side view of the corona charger 2 with the carriage 213 being at the home position. In the state (the open state) illustrated in FIG. 6(*a*), the grid electrode 206 extends substantially parallel to the photosensitive drum, and the gap between the grid electrode 206 and the photosensitive drum 1 is about 1.0 to 1.5 mm in a substantially central part where the two are closer to each other. In the first embodiment, the state where the grid electrode and the photosensitive drum are substantially parallel to each other refers to a state where the ridge of the grid electrode 206 and the generating line of the photosensitive member 1 having a drum shape are at 8 degrees or smaller with respect to each other.

The leading end (the end on the downstream side in the closing direction) of the sheet-type shutter 210 is thicker by the thickness of the leaf spring 212 as the fixed member that pulls the sheet-type shutter. Of course, it is possible to pass the portion having the leaf spring through the gap (of about 1 mm) between the photosensitive member and the grid by improving the assembling accuracy. However, such an option leads to a cost increase. Considering errors in the assembling of the corona charger, allowing the leaf spring and the grid to rub against each other so that the leaf spring is kept out of contact with the photosensitive member is not preferable because the shutter becomes more likely to rub against the grid. Particularly, in a case where an etching grid in the form of a thin plate-type grid having a plurality of openings is employed, if the shutter is opened or closed in a small gap between the photosensitive member and the grid electrode, the thick portion having the leaf spring 212 may be caught by the grid electrode.

Hence, in the corona charger according to the first embodiment, the carriage 213 includes a mechanism of pulling and retracting the grid electrode 206 toward the discharge wire so that the leaf spring 212 as the fixed member that pulls the leading end, in the closing direction, of the sheet-type shutter becomes less likely to interfere with the grid electrode. Therefore, when the open portion is closed with the sheet-type shutter, as illustrated in FIG. 6(*b*), the grid electrode is retracted, whereby the rubbing of the leaf spring or the sheet-type shutter against the grid electrode can be suppressed.

Since the grid electrode is retracted toward the discharge wire, the grid cleaning member 250 bites into the grid electrode 206 by a predetermined amount. Thus, the grid electrode can be cleaned by the grid cleaning member 250.

FIG. 6(*c*) is a side view of the corona charger 2 with the sheet-type shutter being at a position where image formation is not performed (i.e., the position for closing the open portion). In this state, while the carriage 213 includes the cleaning pad 216 that cleans the discharge wire, the open portion excluding an area where the cleaning member is present is shielded. That is, the area effective for image formation is substantially shielded by the shutter. Therefore, the occurrence of image deletion can be fully suppressed. Accordingly, it can be said that the open portion is substantially closed by the sheet-type shutter.

As illustrated in FIGS. 6(*b*) and 6(*c*), the position where the grid electrode is retracted toward the discharge wire substantially coincides with the position of the leaf spring 212. Therefore, the catching of the leaf spring by the grid electrode and the wear of the sheet-type shutter can be suppressed with a slight movement of the grid electrode. Furthermore, since the grid cleaning member 250 is provided close to the position of retraction toward the discharge wire, the cleaning operation can be performed while the biting amount of the cleaning member into the grid electrode is maintained accurately. As described above, the biting amount of the grid cleaning member 250 that corresponds to the amount of retraction of the grid electrode, which will be described below, is 0.7 to 1.3 mm.

When the sheet-type shutter is closed, the entirety of the grid electrode in the longitudinal direction may be retracted toward the wire. In that case, to avoid application of an excessive load to the grid-holding portions, it is preferable to employ a configuration in which the grid-holding portions are movable and are urged by springs so as to absorb any displacements that may occur with the retraction of the grid electrode. Of course, it is desirable to minimize the portion of the grid electrode that is to be retracted, in terms of maintaining the accuracy in the position of the grid electrode.

Therefore, the first embodiment employed a configuration in which a portion (having a width of 5.0 mm) of the grid electrode was retracted toward the discharge wire at a position near the leading end (at the leaf spring) of the shutter on the downstream side in the closing direction. In the first embodiment, the amount of retraction of the grid electrode was 1.0 mm, and the leaf spring was provided near the position of retraction (within 12.0 mm from the position of retraction).

Second Embodiment

In the configuration disclosed by the first embodiment, the sheet-type shutter is curled in the transverse direction such that the two ends are positioned nearer to the charger than the central portion is. A second embodiment concerns a configuration including a regulating portion that regulates the shape of the sheet-type shutter in the transverse direction such that the two ends are positioned nearer to the charger than the central portion is. Elements that are the same as those of the first embodiment are denoted by corresponding ones of the reference numerals used in the first embodiment, and redundant description thereof is omitted accordingly.

Figure 10:
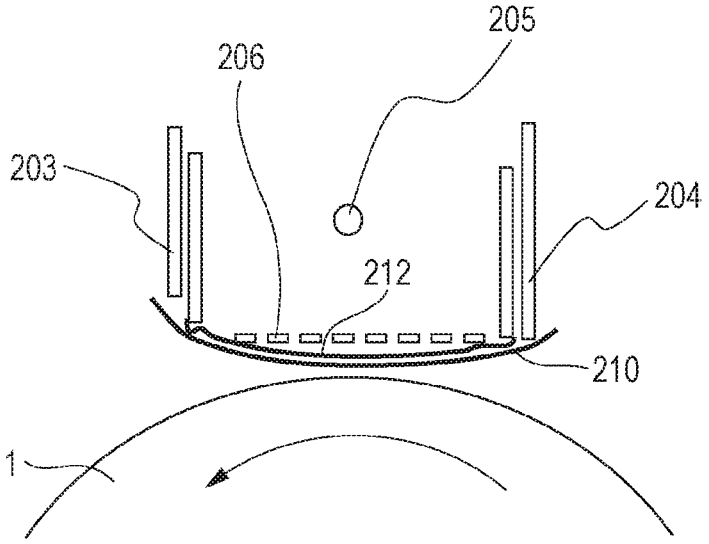
FIG. 10 is a third diagram schematically illustrating a section of the corona charger according to the embodiment.

FIG. 10 is a transverse sectional view of a charger in which the leaf spring 212 provided at the leading end of the sheet-type shutter 210 in the closing direction and that pulls the sheet-type shutter 210 is used as the regulating portion.

The leaf spring 212 as the fixed member itself is shaped in the transverse direction such that the two ends are positioned nearer to the charger than the central portion is. The leading end of the sheet-type shutter in the closing direction is fixed to the leaf spring having such a shape, whereby the sheet-type shutter 210 is also shaped in the transverse direction such that the two ends are positioned nearer to the charger than the central portion is. Thus, the shape of the sheet-type shutter 210 is regulated.

In this case, if the central portion of the leaf spring 212 as the fixed member in the transverse direction interferes with the photosensitive drum 1, the photosensitive drum may be damaged. Therefore, the leaf spring 212 is positioned such that the central portion in the transverse direction does not interfere with the photosensitive drum 1. To position the leaf spring 212 such that the central portion in the transverse direction does not interfere with the photosensitive drum, the curvature of the leaf spring may be set to a small value or the entirety of the leaf spring may be shifted toward the charger.

In the second embodiment also, the gap distance L1 between the shield 203 and the photosensitive drum 1 is larger than the gap distance L2 between the shield 204 and the photosensitive drum 1 as with the case illustrated in FIG. 4(*a*). Therefore, the length of the sheet-type shutter in the transverse direction from the point directly below the discharge electrode to the end that is nearer to the shield 203 is longer than the length of the sheet-type shutter from the point directly below the discharge electrode to the other end that is nearer to the shield 204. Furthermore, the sheet-type shutter is regulated to cover the open portion. Consequently, the amount of discharge products that may adhere to the surface of the photosensitive drum can be further reduced, and the occurrence of image deletion can be suppressed. Furthermore, the winding means according to the first embodiment may be employed. Furthermore, the curling process according to the first embodiment may be performed on the sheet-type shutter.

Third Embodiment

Now, a third embodiment will be described. Elements that are the same as those of the first or second embodiment are denoted by corresponding ones of the reference numerals used in the first or second embodiment, and redundant description thereof is omitted accordingly. FIG. 11 illustrates a charging device according to the third embodiment. The third embodiment is the same as the second embodiment in that the shape of the sheet-type shutter is regulated by the regulating portion, but differs from the second embodiment in the regulating method. As illustrated in FIG. 11, rail-type guide members 300 extend in the longitudinal direction of the housing and along the shields provided on the two respective longitudinal side faces of the charger. The guide members as the regulating portions each have an open portion extending in the longitudinal direction. The two ends of the sheet-type shutter in the transverse direction are each inserted into the open portion of a corresponding one of the guide members. Thus, the sheet-type shutter is held in such a manner as to be movable in the longitudinal direction, whereby the two ends of the sheet-type shutter in the transverse direction is guided. In such a configuration, the central portion of the sheet-type shutter in the transverse direction that is not held by the guide members sags down under its own weight. Thus, the shape of the sheet-type shutter is regulated such that the two ends of the sheet-type shutter 210 in the transverse direction that are held by the guide members are positioned nearer to the corona charger than the central portion is.

Since only the two ends of the sheet-type shutter 210 in the transverse direction are guided by the guide members 300 in such a manner as to be brought closer to the corona charger, the gap distance between the sheet-type shutter 210 and each of the shields 203 and 204 can be made smaller. A distance L5 between the shield 203 and the sheet-type shutter 210 in the case illustrated in FIG. 4(*b*) described above is 7.5 mm. A distance L6 between the shield 203 and the sheet-type shutter 210 according to the second embodiment illustrated in FIG. 11 is 3.5 mm. Since the gap between the sheet-type shutter and each of the shields is reduced by using the end guide members, the amount of leakage of discharge products can be reduced.

Figure 12:
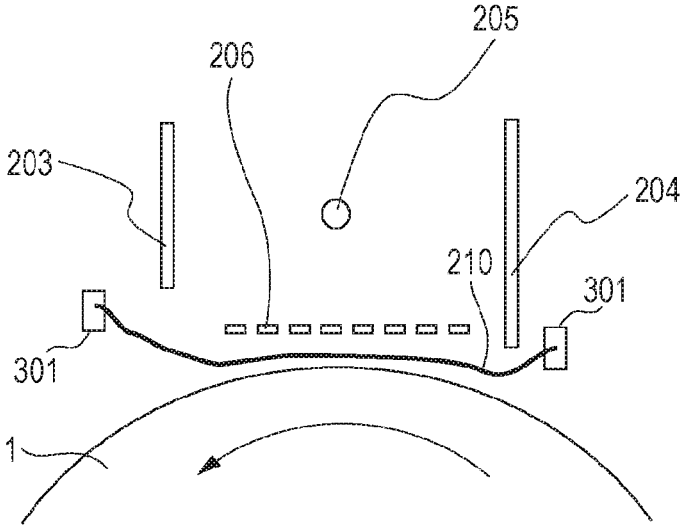
FIGS. 12 (12*a* and 12*b*) is a fifth diagram schematically illustrating a section of the corona charger according to the embodiment.
Figure 12:
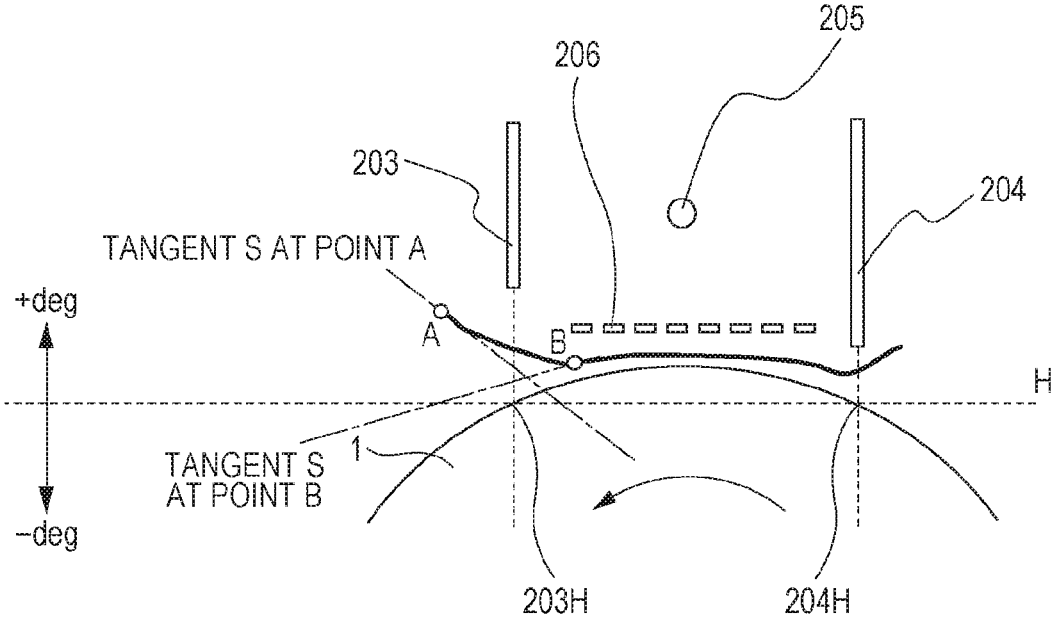

FIG. 12 illustrates guide members of another type. The distances between the sheet-type shutter 210 and the shields 203 and 204 do not necessarily need to be made small. If the sheet-type shutter 210 is shaped in such a manner as to cover the open portion with only the ends thereof lifted by guide members 301, respectively, as illustrated in FIG. 12, the occurrence of image deletion due to discharge products can be suppressed.

Drawing an extension of the shield 203 of the corona charger 2 toward the photosensitive drum 1, let the intersection of the photosensitive drum and the extension of the shield 203 be denoted by 203H. Likewise, drawing an extension of the shield 204 toward the photosensitive drum 1, let the intersection of the photosensitive drum and the extension of the shield 204 be denoted by 204H. Furthermore, let the line connecting the intersection 203H and the intersection 204H be denoted as reference line H. With respect to the reference line H, the angle formed on the side nearer to the discharge wire 205 is defined as the positive angle, and the angle formed on the side nearer to the photosensitive drum 1 is defined as the negative angle. Then, a tangent S to the curve of the sheet-type shutter is obtained for each point of the sheet-type shutter 210, and the angle between the reference line H and the tangent S is obtained.

For example, referring to FIG. 12(*b*), the angle between a tangent S1 at a point A, which is an end of the sheet-type shutter 210, and the reference line H is positive. In contrast, the angle between a tangent S1 at a point B, which is between the end and the center of the sheet-type shutter 210, and the reference line H is negative. In the configuration illustrated in FIG. 12, the effect of preventing the defect due to discharge products in relation to the angle and the position of guiding of the sheet-type shutter was examined. It has been found that the effect of preventing the defect due to discharge products is great when the shutter is guided by the end guide members 301 such that the angle between the tangent S and the reference line H becomes positive. Hence, if the sheet-type shutter 210 is guided by the guide members 300 or 301, the sheet-type shutter 210 needs to be guided such that the angle between the tangent S and the reference line H becomes positive.

The effect produced by guiding the sheet-type shutter by the guide members not only reduces the influence of discharge products but also enables the guiding of the sheet-type shutter 210 while positioning the sheet-type shutter 210 by the guide members 300 or 301. Even if the sheet-type shutter 210 is made of a soft, flexible material and tends to be twisted, the use of the guide members allows the sheet-type shutter 210 to be assuredly positioned and moved without displacements.

Note that guiding the sheet-type shutter by using the guide members 300 or the end guide members 301 may increase the probability that a portion of the sheet-type shutter that is near the center in the transverse direction may interfere with the photosensitive drum 1. However, as described in the first embodiment, to prevent the photosensitive drum from being damaged at the interference with the sheet-type shutter, the sheet-type shutter 210 may be a piece of soft, flexible, sheet-type nonwoven fabric having a thickness of 0.15 mm and including rayon fibers. In that case, there is no problem even if the sheet-type shutter 210 interferes with the photosensitive drum 1.

Figure 13:
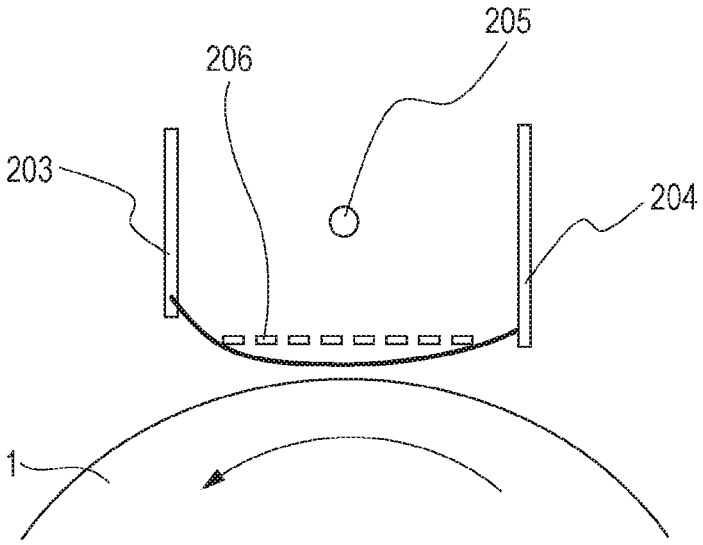
FIG. 13 is a sixth diagram schematically illustrating a section of the corona charger according to the embodiment.

The first to third embodiments have been described with reference to the drawings each illustrating the sheet-type shutter whose ends in the transverse direction each extend beyond the housing. The present invention is not limited to such a case. As illustrated in FIG. 13, the sheet-type shutter may be shaped such that the ends thereof in the transverse direction are in contact with the longitudinal inner side faces of the respective shields forming the housing. Moreover, a portion of the shutter in the longitudinal direction may come into contact with the shields within an area extending in the longitudinal direction of the shields and in which the open portion is provided. If the open portion is thus tightly closed when seen in a section that is orthogonal to the longitudinal direction of the shields, the leakage of discharge products from the open portion can be suppressed.

The first embodiment concerns an exemplary case where the shutter is curled over the entirety thereof in the longitudinal direction. In the case where the leaf spring as the fixed member is fixed to the leading end of the shutter in the longitudinal direction as in the first embodiment, the shape of the leading end of the shutter is regulated by the leaf spring even if the shutter has been curled. Therefore, in the case where the leaf spring is fixed to the leading end of the shutter, the leading end of the shutter to which the leaf spring is fixed does not necessarily need to be curled. In other words, at least in a portion of the shutter in the longitudinal direction excluding the leading end to which the fixed member is fixed is curled.

The present invention is not limited to the above embodiments, and various changes and modifications can be made thereto without departing from the spirit and scope of the present invention. Accordingly, to publicize the scope of the present invention, the following claims are attached.

This application claims the benefit of Japanese Patent Application No. 2013-136147 filed Jun. 28, 2013 and No. 2014-125612 filed Jun. 18, 2014, which are hereby incorporated by reference herein in their entirety.

REFERENCE SIGNS LIST

100 image forming apparatus
1 photosensitive member (image bearing member, charging object)
2 corona charger (scorotron)
203, 204 shield (housing)
205 discharge wire (discharge electrode)
206 grid (control electrode)
207, 209 grid holding portion (holding portion)
210 sheet-type shutter (shielding member)
211 winding mechanism (winding means)
211*a* first example of shutter winding roller (winding member)
211*b* second example of shutter winding roller (winding member)
213 carriage (movable member)
213A tapered portion (retracting mechanism)
250 cleaning brush (grid cleaning member)
300 guide member
301 end guide member
303, 304 shutter stopping member

The invention claimed is:

1. A charging device that charges a photosensitive member, the charging device comprising:

a corona charger including a discharge electrode that discharges electricity when a voltage is applied, shields that are provided on two respective sides of the discharge electrode, and an open portion that is provided nearer to the photosensitive member than the discharge electrode is;

a sheet-type shutter movable for opening and closing the open portion;

a fixed member fixed to a leading end of the shutter that is on a downstream side in a direction in which the shutter moves when the shutter is closed; and a moving mechanism that holds the fixed member and moves the shutter in a longitudinal direction of the corona charger, wherein at least a portion of the shutter in the longitudinal direction excluding the leading end to which the fixed member is fixed is curled in a transverse direction of the shutter such that a central portion bulges, with respect to two ends, in a thickness direction of the shutter from a front surface that is nearer to the discharge electrode toward a back surface that is farther from the discharge electrode.

2. The charging device according to claim 1, wherein the moving mechanism includes a movable member that holds the fixed member and is movable in the longitudinal direction of the corona charger, and wherein the fixed member regulates a shape of the leading end of the shutter in the transverse direction of the shutter such that the central portion bulges, with respect to the two ends, in the thickness direction of the shutter from the back surface toward the front surface.

3. The charging device according to claim 1, further comprising:

a winding mechanism that winds up the shutter when the shutter is opened, wherein the winding mechanism winds up the shutter such that the front surface faces inward when the shutter is closed.

4. The charging device according to claim 3, wherein the winding mechanism includes a winding shaft onto which the shutter is wound, and an outside diameter of a portion of the winding shaft within which the shutter is wound is smaller at each of two ends than in a central part in a rotation-axis direction of the winding shaft.

5. The charging device according to claim 1, wherein the discharge electrode extends in the longitudinal direction of the corona charger, wherein the plurality of shields include a first shield portion and a second shield portion that face each other while extending in a longitudinal direction of the discharge electrode, and wherein, in a plane orthogonal to the longitudinal direction of the discharge electrode, an end of the first shield portion that is nearer to the photosensitive member is positioned farther from the photosensitive member than an end of the second shield portion that is nearer to the photosensitive member is; and the shutter is curled such that, in the thickness direction of the shutter from the back surface toward the front surface, one end of the shutter in the transverse direction that is nearer to the first shield portion extends beyond the other end of the shutter in the transverse direction that is nearer to the second shield portion.

6. The charging device according to claim 1, wherein the shutter is curled such that, when the shutter is closed, a portion of the shutter in the longitudinal direction comes into contact with the shields within an area extending in a longitudinal direction of the shields and in which the open portion is provided.

7. The charging device according to claim 1, wherein the leading end of the shutter to which the fixed member is fixed is curled in the transverse direction of the shutter such that a central portion bulges, with respect to two ends, in the thickness direction of the shutter from the front surface toward the back surface.

8. A charging device that charges a photosensitive member, the charging device comprising:

a corona charger including a discharge electrode that discharges electricity when a voltage is applied, a plurality of shields that are provided on two respective sides of the discharge electrode, and an open portion that is provided nearer to the photosensitive member than the discharge electrode is;

a shutter movable for opening and closing the open portion;

a plate-type fixed member fixed to a leading end of the shutter that is on a downstream side in a direction in which the shutter moves when the shutter is closed; and a moving mechanism that holds the fixed member and moves the shutter in a longitudinal direction of the corona charger, wherein the shutter is a sheet-type member that is curled in a transverse direction such that a central portion bulges with respect to two ends; the shutter is attached to the corona charger in an orientation in which, when the shutter is closed, the central portion in the transverse direction that bulges by being curled bulges in a direction from a front surface of the shutter that is nearer to the discharge electrode toward a back surface of the shutter that is farther from the discharge electrode; and the fixed member regulates a shape of the leading end of the shutter in the transverse direction of the shutter such that the central portion bulges, with respect to the two ends, in a thickness direction of the shutter from the back surface toward the front surface.

9. The charging device according to claim 8, further comprising:

a winding mechanism that winds up the shutter when the shutter is opened, wherein the winding mechanism winds up the shutter such that the front surface faces inward when the shutter is closed.

10. The charging device according to claim 9, wherein the winding mechanism includes a winding shaft onto which the shutter is wound, and an outside diameter of a portion of the winding shaft within which the shutter is wound is smaller at each of two ends than in a central part in a rotation-axis direction of the winding shaft.

11. The charging device according to claim 8, wherein the discharge electrode extends in the longitudinal direction of the corona charger, wherein the plurality of shields include a first shield portion and a second shield portion that face each other while extending in a longitudinal direction of the discharge electrode, and wherein, in a plane orthogonal to the longitudinal direction of the discharge electrode, an end of the first shield portion that is nearer to the photosensitive member is positioned farther from the photosensitive member than an end of the second shield portion that is nearer to the photosensitive member is; and the shutter is curled such that, in the thickness direction of the shutter from the back surface toward the front surface, one end of the shutter in the transverse direction that is nearer to the first shield portion extends beyond the other end of the shutter in the transverse direction that is nearer to the second shield portion.

12. The charging device according to claim 8, wherein the shutter is curled such that, when the shutter is closed, a portion of the shutter in the longitudinal direction comes into contact with the shields within an area extending in a longitudinal direction of the shields and in which the open portion is provided.

13. A charging device that charges a photosensitive member, the charging device comprising:

a corona charger including a discharge electrode that discharges electricity when a voltage is applied, a plurality of shields that are provided on two respective sides of the discharge electrode, and an open portion that is provided nearer to the photosensitive member than the discharge electrode is;

a sheet-type shutter movable for opening and closing the open portion; and a moving mechanism that moves the shutter in a longitudinal direction of the corona charger, wherein the corona charger further includes a regulating portion that regulates a shape of the shutter in the transverse direction of the shutter such that, in a state where the shutter is closed, a central portion bulges, with respect to two ends, in a thickness direction of the shutter from a front surface that is nearer to the discharge electrode toward a back surface that is farther from the discharge electrode.

14. A charging device that charges a photosensitive member, the charging device comprising:

a corona charger including a discharge electrode that discharges electricity when a voltage is applied, shields that are provided on two respective sides of the discharge electrode, and an open portion that is provided nearer to the photosensitive member than the discharge electrode is;

a sheet-type shutter movable for opening and closing the open portion;

a fixed member fixed to a leading end of the shutter that is on a downstream side in a direction in which the shutter moves when the shutter is closed; and a moving mechanism that holds the fixed member and moves the shutter in a longitudinal direction of the corona charger, wherein at least a central portion of the shutter in the longitudinal direction is curled in a transverse direction of the shutter such that a central portion bulges, with respect to two ends, in a thickness direction of the shutter from a front surface that is nearer to the discharge electrode toward a back surface that is farther from the discharge electrode.

15. The charging device according to claim 14, wherein the moving mechanism includes a movable member that holds the fixed member and is movable in the longitudinal direction of the corona charger, and wherein the fixed member regulates a shape of the leading end of the shutter in the transverse direction of the shutter such that the central portion bulges, with respect to the two ends, in the thickness direction of the shutter from the back surface toward the front surface.

16. The charging device according to claim 14, further comprising:

a winding mechanism that winds up the shutter when the shutter is opened, wherein the winding mechanism winds up the shutter such that the front surface faces inward when the shutter is closed.

17. The charging device according to claim 16, wherein the winding mechanism includes a winding shaft onto which the shutter is wound, and an outside diameter of a portion of the winding shaft within which the shutter is wound is smaller at each of two ends than in a central part in a rotation-axis direction of the winding shaft.

18. The charging device according to claim 14, wherein the discharge electrode extends in the longitudinal direction of the corona charger, wherein the plurality of shields include a first shield portion and a second shield portion that face each other while extending in a longitudinal direction of the discharge electrode, and wherein, in a plane orthogonal to the longitudinal direction of the discharge electrode, an end of the first shield portion that is nearer to the photosensitive member is positioned farther from the photosensitive member than an end of the second shield portion that is nearer to the photosensitive member is; and the shutter is curled such that, in the thickness direction of the shutter from the back surface toward the front surface, one end of the shutter in the transverse direction that is nearer to the first shield portion extends beyond the other end of the shutter in the transverse direction that is nearer to the second shield portion.

19. The charging device according to claim 14, wherein the shutter is curled such that, when the shutter is closed, a portion of the shutter in the longitudinal direction comes into contact with the shields within an area extending in a longitudinal direction of the shields and in which the open portion is provided.

20. The charging device according to claim 14, wherein the leading end of the shutter to which the fixed member is fixed is curled in the transverse direction of the shutter such that a central portion bulges, with respect to two ends, in the thickness direction of the shutter from the front surface toward the back surface.

21. The charging device according to claim 14, wherein the shutter oneself is cured beforehand.

* * * * *